US010544557B1

(12) United States Patent
Island

(10) Patent No.: US 10,544,557 B1
(45) Date of Patent: Jan. 28, 2020

(54) WASTE SCOOPER

(71) Applicant: Milton Island, North Hills, CA (US)

(72) Inventor: Milton Island, North Hills, CA (US)

( * ) Notice: Subject to any disclaimer, the term of this patent is extended or adjusted under 35 U.S.C. 154(b) by 0 days.

(21) Appl. No.: 16/253,121

(22) Filed: Jan. 21, 2019

(51) Int. Cl.
*E01H 1/12* (2006.01)

(52) U.S. Cl.
CPC ..... *E01H 1/1206* (2013.01); *E01H 2001/126* (2013.01)

(58) Field of Classification Search
CPC ..... E01H 1/1206; E01H 2001/122; E01H 2001/1226; E01H 2001/126; B65F 2240/138
USPC ..... 294/1.3, 214
See application file for complete search history.

(56) References Cited

U.S. PATENT DOCUMENTS 4,138,153 A * 2/1979 Brown ..... E01H 1/1206 15/257.1
5,282,660 A * 2/1994 Halling ..... E01H 1/1206 15/257.1
5,476,296 A * 12/1995 Gross ..... E01H 1/1206 294/1.3
5,836,629 A * 11/1998 Hobart ..... E01H 1/1206 294/1.3
6,045,170 A * 4/2000 Allen ..... E01H 1/1206 294/1.3
7,278,377 B1 * 10/2007 Stephens ..... E01H 1/1206 119/867
2008/0048463 A1 * 2/2008 Selenke ..... E01H 1/1206 294/1.3
2011/0042978 A1 * 2/2011 Elhadary ..... E01H 1/12 294/1.3
2011/0309645 A1 * 12/2011 Briscoe ..... E01H 1/1206 294/1.3

* cited by examiner

*Primary Examiner* — Dean J Kramer

(57) ABSTRACT

A biodegradable and disposable waste scooper includes a waste scoop, a waste bag, and a securing mechanism. The waste scoop is fully engulfed by the waste bag to keep animal wastes from directly contacting with user's hands or cloth during the cleaning process. The waste bag includes a securing mechanism to seal the waste bag's opening. After the user scoop up animal wastes, the user may tilt the waste scoop and move animal wastes into the waste bag for storage and seal the waste bag's opening with the securing mechanism. The user may reopen the waste bag to dump animal wastes from the waste bag for disposal or may dispose the entire invention without burdening the environment.

14 Claims, 7 Drawing Sheets

WASTE SCOOPER

FIELD OF THE INVENTION

The present invention relates generally to a waste scooper. More specifically, a biodegradable and disposable waste scooper that combines a scooping device with a storage device by having the storage device engulfing the scooping device to prevent animal wastes from contacting the user's hand, and capable of collecting and storing animal wastes at the same time.

BACKGROUND OF THE INVENTION

Many people are accompanied by animal every day, including but not limited to pets or farm animals. Due to the limitation of available space and sanitary reason, human can no longer leave wastes generated by domestic animals lying around. However, cleaning up animal waste can raise several issues. First, without proper tool, animal wastes can get on the user's hands or cloths when the user is trying to pick up or shovel up animal wastes. Second, after animal wastes are picked up, the user needs a storage device to gather those wastes before disposal. Third, animal wastes may be positioned on different types of surfaces, which may be hard for a regular shoveling device to pick up those wastes.

The present invention presents solutions to all issues mentioned above by providing a combination of a scooping device and a storage device. The storage device is a plastic bag connecting and engulfing the scooping device to prevent animal wastes from contacting the user directly during the cleaning up process. Moreover, since the storage device is engulfing the scooping device, the user can store animal wastes immediately, saving the trouble of retrieving a separate storage device to store animal wastes. Finally, the present invention provides a scooping device with a round shape blade, which does not include any sharp edge and can adapt to different types of surface, such as but not limited to grass, concrete, or even tile.

DETAIL DESCRIPTIONS OF THE INVENTION

All illustrations of the drawings are for the purpose of describing selected versions of the present invention and are not intended to limit the scope of the present invention.

Figure 2:
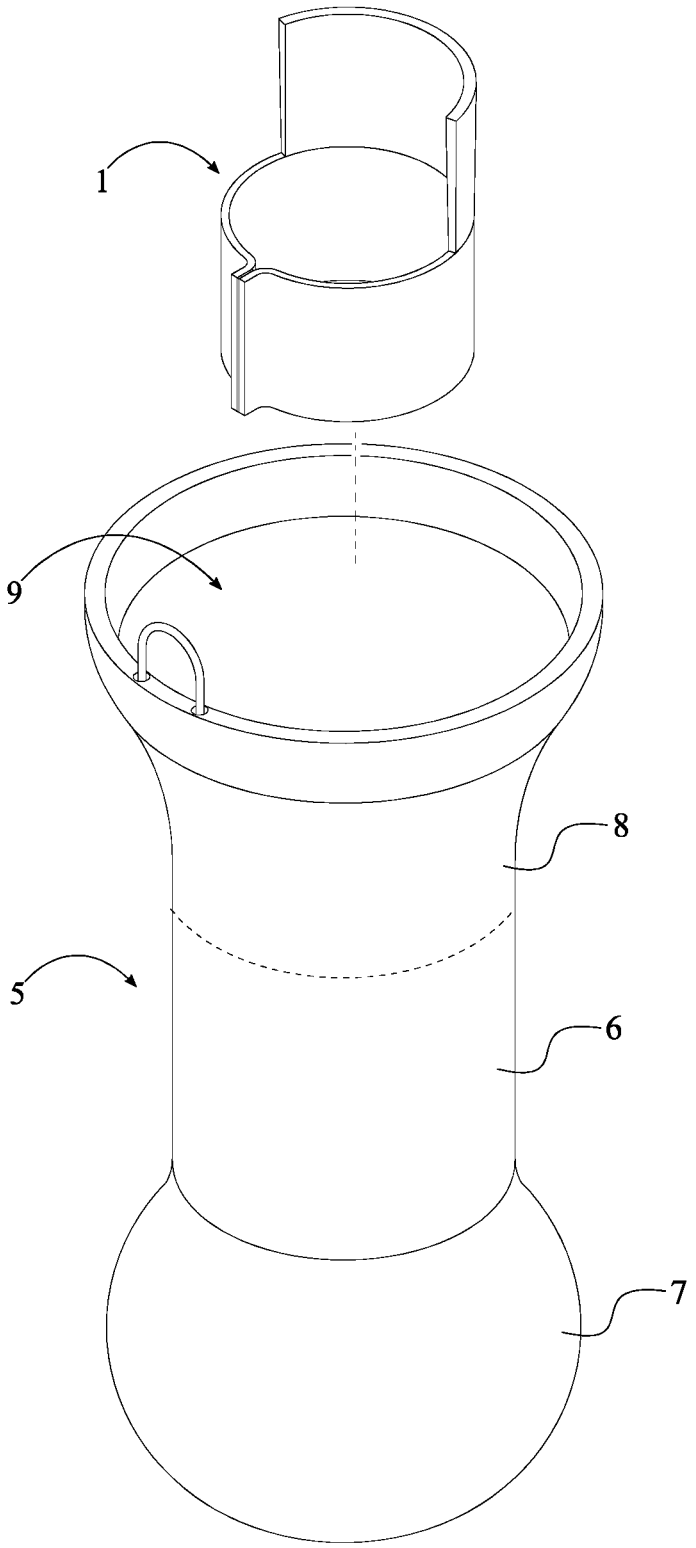
FIG. 2 is an isometric view showing the waste bag and the waste scoop being separated.
Figure 3:
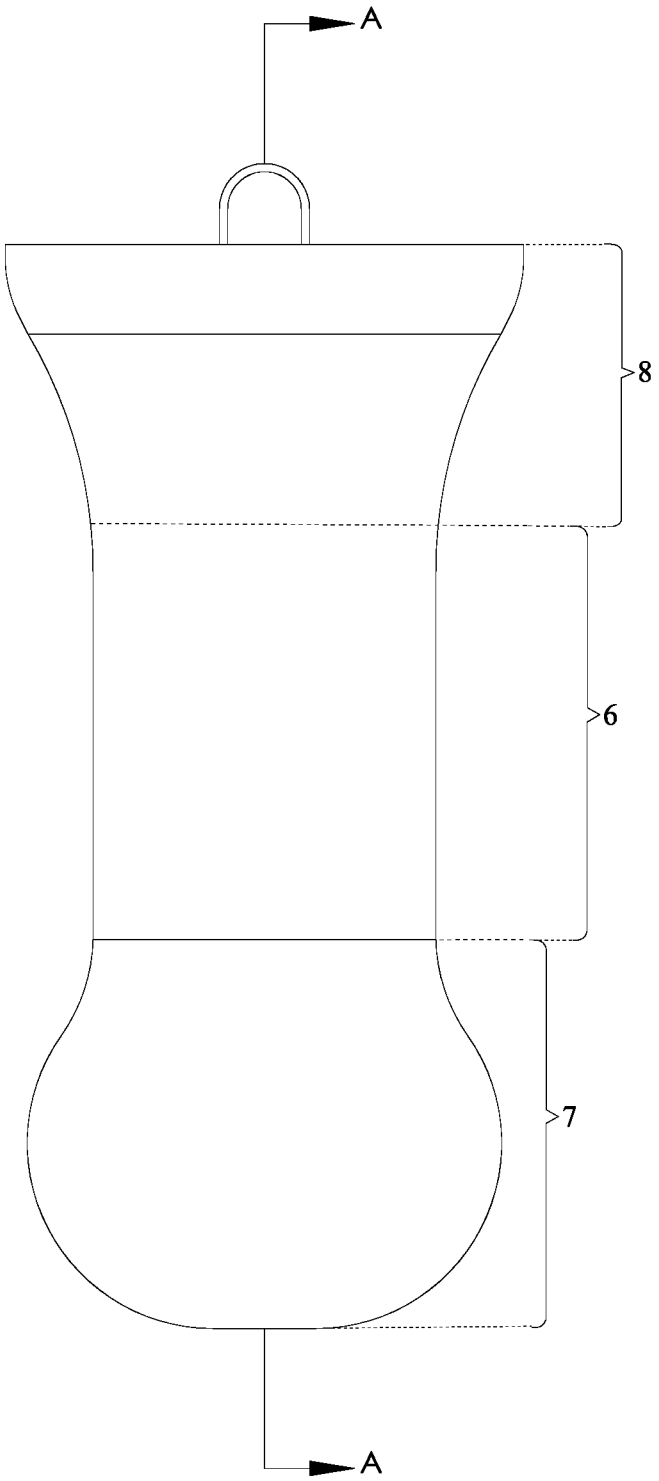
FIG. 3 is a side view of the present invention, showing the plane upon which a cross sectional view is taken shown in FIG. 4.

In reference to FIGS. 2 and 3, the present invention is a biodegradable and disposable animal waste scooper configured to allow the user to safely retrieving and storing wastes without having to directly contact the wastes. The present invention comprises a waste scoop 1, a waste bag 5, and a securing mechanism 10. The waste scoop 1 is mounted within the waste bag 5 and is configured to allow the user to collect animal wastes from the ground or other surfaces. The waste bag 5 is configured to prevent animal wastes from directly contacting the user's hand or cloth and also capable of storing animal wastes collected by the waste scoop 1. After the user picks up animal wastes with the waste scoop 1, the user may tilt the waste scoop 1 upward and allow animal wastes to fall from the waste scoop 1 into the waste bag 5 for storage. The waste bag 5 comprises a connecting portion 6, a receptacle portion 7, a protective layer 8, and an opening 9. The connecting portion 6 is connected around an exterior surface of the waste scoop 1 and is configured to prevent separation or accidental removal of the waste scoop 1 from the waste bag 5. The connecting portion 6 connects the exterior surface of the waste scoop 1 to the interior surface of the waste bag 5 and configured to prevent animal wastes moving toward the opening 9 of the waste bag 5 along the outer surface of the waste scoop 1. The protective layer 8 is connected adjacent to the connecting portion 6 and is configured to prevent animal wastes from directly contacting the user's hand or cloth when the user is scooping animal wastes with the waste scoop 1 by engulfing the waste scoop 1 and form a barrier between the user's hand and the waste scoop 1. Instead of contacting the user's hand, animal wastes contact the protective layer 8.

Figure 1:
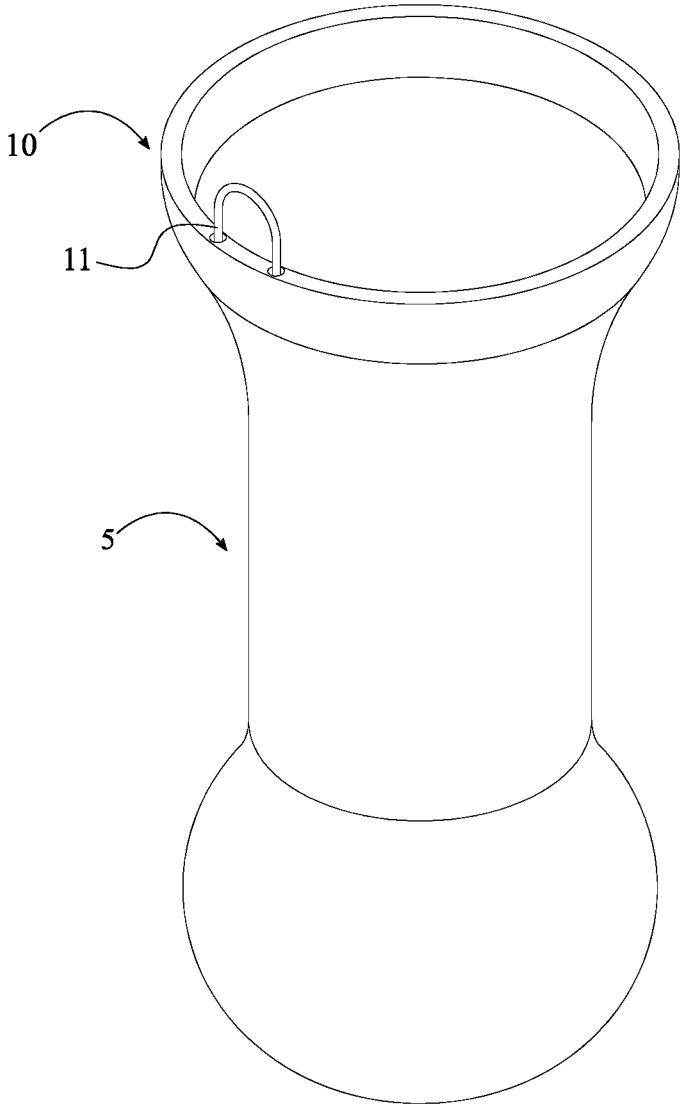
FIG. 1 is an isometric perspective view of the present invention.
Figure 4:
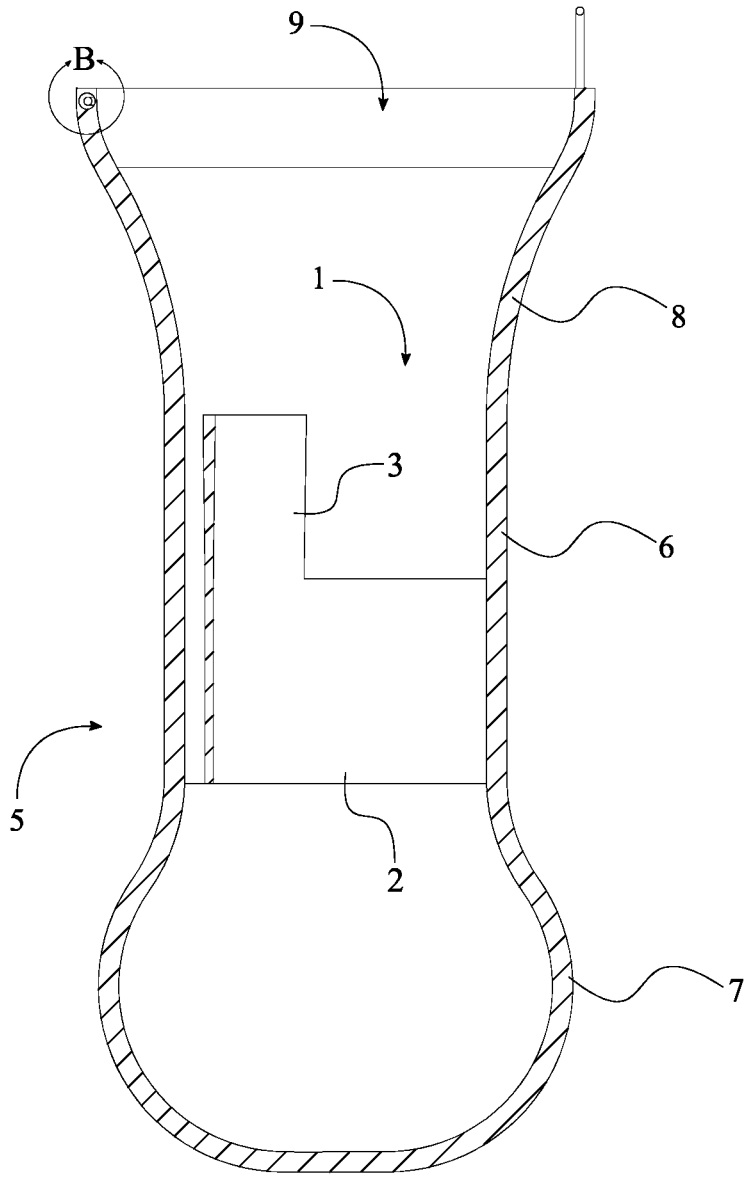
FIG. 4 is a cross section view of the present invention taken along line A-A of FIG. 3.

In reference to FIGS. 1 and 4, the receptacle portion 7 is connected adjacent to the connecting portion 6, opposite to the protective layer 8. The receptacle portion 7 is configured to store the waste collected by the waste scoop 1 before the user disposes animal wastes collected. The user then tilts the waste scoop 1 to allow animal wastes to fall from the waste scoop 1 into the receptacle portion 7 of the waste bag 5. The opening 9 is delineated by the protective layer 8 and is configured to allow the user to introduce waste or other objects into the waste bag 5. The securing mechanism 10 is operatively integrated into the protective layer 8, wherein the securing mechanism 10 selectively seals the opening 9. The securing mechanism 10 is configured to allow the user to seal the opening 9 to contain both smell and animal wastes collected by the waste scoop 1 and prevent animal wastes from existing the waste bag 5.

Figure 5:
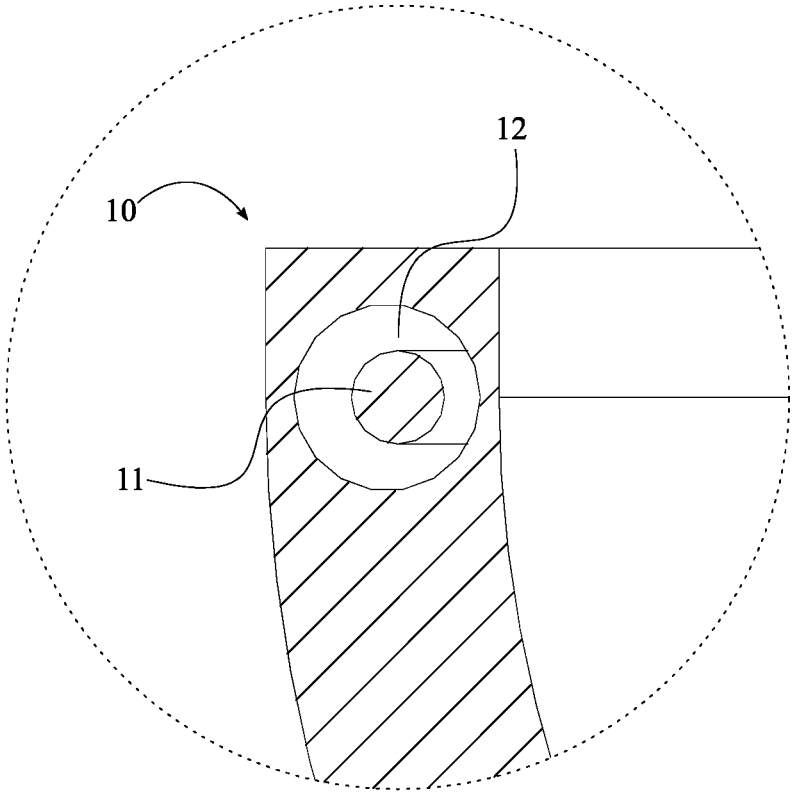
FIG. 5 is a detail view of the securing mechanism taking along the circle B of FIG. 4.
Figure 6:
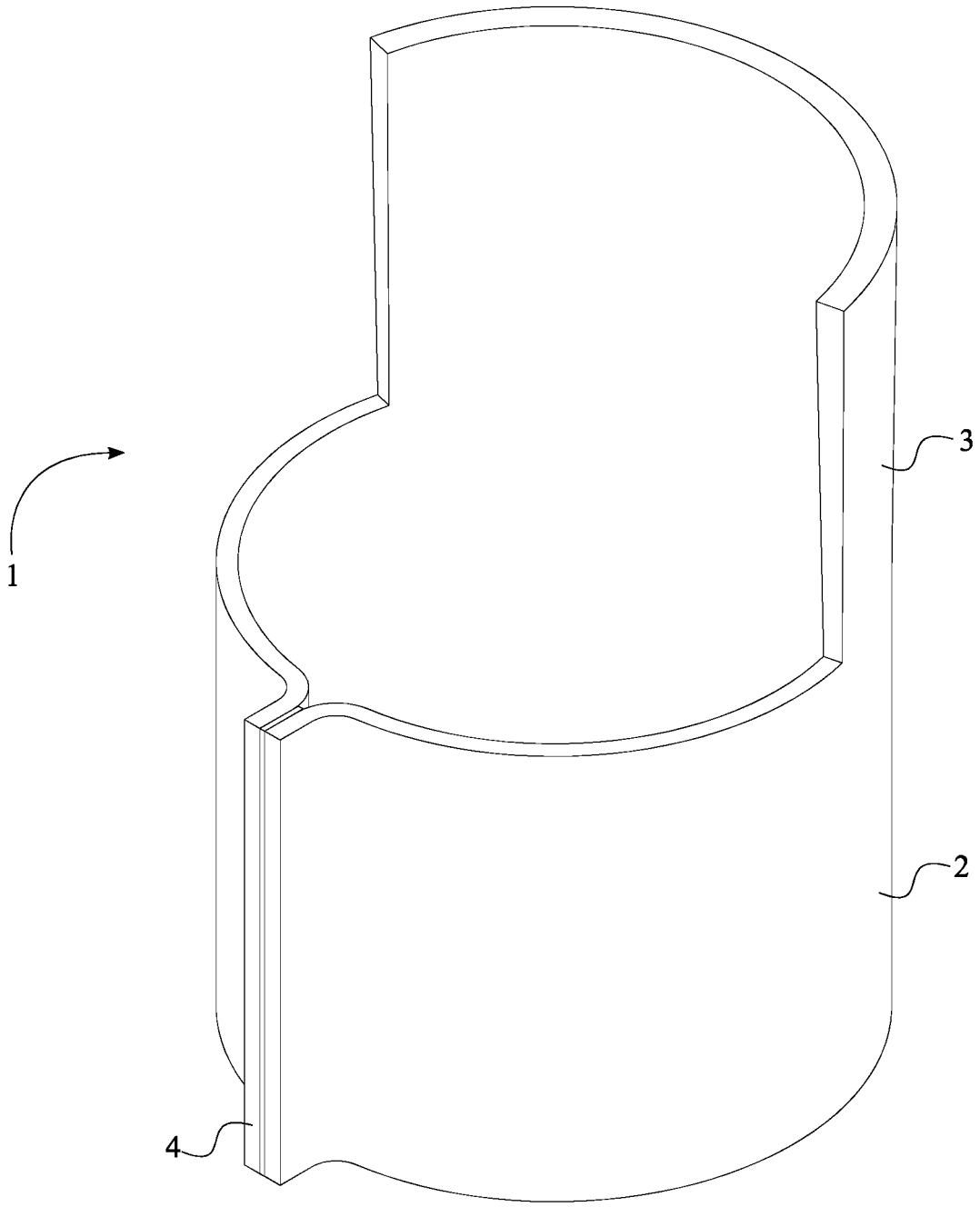
FIG. 6 is an isometric view of the waste scoop.

In reference to FIG. 4-6, the waste scoop 1 comprises a main body 2, a blade portion 3, and a handle portion 4. The blade portion 3 is terminally connected to the main body 2 and is configured to directly contact the waste and allow the user to shovel up and remove the waste from the ground or other surfaces. For example, the user can insert the blade portion 3 of the waste scoop 1 under animal wastes and lift animal wastes from the ground. The handle portion 4 is terminally connected to the main body 2, opposite to the blade portion 3. The handle portion 4 is positioned within the connecting portion 6. The handle portion 4 is configured to allow the user to grasp onto the present invention to shovel and store animal wastes. The protective layer 8 extends towards the blade portion 3 and is configured to cover the blade portion 3 entirely when the user seals the opening 9 with the securing mechanism 10 after all animal wastes has been collected and stored, and the user is ready to dispose those wastes.

In reference to FIGS. 4 and 5, the securing mechanism 10 comprises a drawstring 11 and a string conduit 12. The string conduit 12 is externally connected around the protective layer 8 and connected around the opening 9. The string conduit 12 is configured to form a loop on the protective layer 8 and provide a channel to contain the drawstring 11. The drawstring 11 traversing through the string conduit 12 and are configured to allow the user to pull and tighten the securing mechanism 10 to seal the opening 9. The string conduit 12 is slidably engaged with the drawstring 11 and is configured to allow the drawstring 11 to slide within the string conduit 12. The user may pull on the drawstring 11 to close the opening 9 or loosen the drawstring 11 to open the opening 9 to remove animal wastes.

Figure 7:
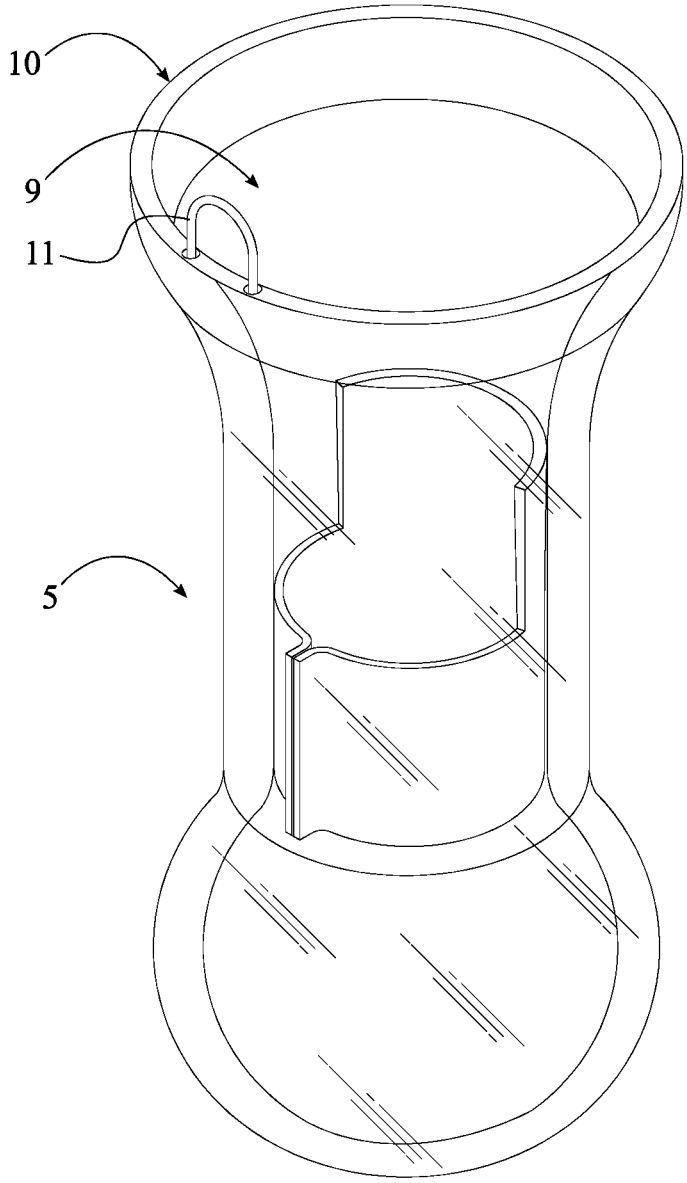
FIG. 7 is another embodiment of the present invention, wherein the waste bag is transparent.

In reference to FIG. 7, in one embodiment, the waste bag 5 is made from translucent and transparent materials to allow the user to visualize the amount of wastes collected and stored in the waste bag 5. In other embodiments, the waste bag may not be transparent. The user may choose to discard the present invention entirely or empty the waste bag 5 by squeezing the waste bag 5 to force stored wastes out of the waste bag 5. The user may also turn the present invention upside down to dump animal wastes out of the waste bag 5.

In reference to FIG. 4, the connecting portion 6 is positioned on the inner surface of the waste bag 5 and is glued around the external surface of the main body 2 of the waste scoop 1 so that the waste scoop 1 can be connected to the waste bag 5 when the user is scooping up the waste. Gluing the connecting portion 6 to the main body 2 also maintains the waste bag 5 in the same position relative to the waste scoop 1, so the waste bag 5 does not unpeel itself from the waste scoop 1 while the user scoops up animal waste and cause animal waste to contact the user's hand directly.

In reference to FIG. 6, the waste scoop 1 is formed from a T-shaped circular body in the unfolded state, which is configured to be a L-shaped structure in the folded state. When the user needs to clean up animal wastes, the user may take out the present invention, unfold and expand the main body 2 and the blade portion 3 into circular shapes, then proceed with scooping of animal wastes.

In reference to FIG. 1-3, the waste scoop 1, the waste bag 5, and the securing mechanism 10 are made of biodegradable materials, which allows the user to dispose of the waste scoop 1 without burdening the environment. After animal wastes are collected by the waste scoop 1 and stored in the waste bag 5, the user may choose to dispose the waste only and reuse the present invention or may choose to dispose the present invention along with the waste without burdening the environment.

The user may use the present invention in the following method: First, the user unfolds the waste scoop 1 from the L-shaped structure to the T-shaped circular body, then the user needs to check whether the waste scoop 1 remains connected to the connecting portion 6 of the waste bag 5. Then the user may unpeel the protective layer 8 from covering the blade portion 3 to start scooping up animal wastes from ground or other surfaces. The user may also wrap the protective layer 8 around the user's hand to prevent animal wastes from contacting the user's hands. The user may tilt the blade portion 3 upward after each scoop so animal wastes can fall into the receptacle portion 7 for storage. After all animal wastes have been collected, the user may pull the drawstring 11 to pull up the protective layer 8 to close the opening 9. Finally, since the entire invention is made from biodegradable material, the user may dispose the entire invention without taking out animal wastes.

Although the invention has been explained in relation to its preferred embodiment, it is to be understood that many other possible modifications and variations can be made without departing from the spirit and scope of the invention as hereinafter claimed.

What is claimed is:

1. A waste scooper for safely retrieving and storing waste comprises:

a waste scoop;
a waste bag;
a securing mechanism;
the waste bag comprises a connecting portion, a receptacle portion, a protective layer, and an opening;
the waste scoop being mounted within the waste bag;
the connecting portion being externally connected around the waste scoop;
the protective layer being connected adjacent to the connecting portion;
the receptacle portion being connected adjacent to the connecting portion, opposite the protective layer;
the opening being delineated by the protective layer;
the securing mechanism being operatively integrated into the protective layer, wherein the securing mechanism selectively seals the opening;
the waste scoop comprises a main body, a blade portion, and a handle portion;
the blade portion being terminally connected to the main body;
the handle portion being terminally connected to the main body, opposite the blade portion;
the handle portion being positioned within the connecting portion; and
the protective layer extending towards the blade portion.

2. The waste scooper for safely retrieving and storing waste as claimed in claim 1 comprises:

the securing mechanism comprises a drawstring and a string conduit;
the string conduit being externally connected around the protective layer;
the string conduit being connected around the opening;
the drawstring traversing through the string conduit; and
the string conduit being slidably engaged with the drawstring.

3. The waste scooper for safely retrieving and storing waste as claimed in claim 1, wherein the connecting portion is externally glued around the waste scoop.

4. The waste scooper for safely retrieving and storing waste as claimed in claim 1, wherein the waste scoop is a circular body.

5. The waste scooper for safely retrieving and storing waste as claimed in claim 1, wherein the waste bag is made of biodegradable material.

6. The waste scooper for safely retrieving and storing waste as claimed in claim 1, wherein the waste scoop is made of biodegradable material.

7. The waste scooper for safely retrieving and storing waste as claimed in claim 1, wherein the securing mechanism is made of biodegradable material.

8. A waste scooper for safely retrieving and storing waste comprises:

a waste scoop;
a waste bag;
a securing mechanism;
the waste bag comprises a connecting portion, a receptacle portion, a protective layer, and an opening;
the waste scoop being mounted within the waste bag;
the waste scoop comprises a main body, a blade portion, and a handle portion;
the blade portion being terminally connected to the main body;
the handle portion being terminally connected to the main body, opposite the blade portion;
the handle portion being positioned within the connecting portion;
the protective layer extending towards the blade portion;

the connecting portion being externally connected around the waste scoop;

the protective layer being connected adjacent to the connecting portion;

the receptacle portion being connected adjacent to the connecting portion, opposite the protective layer;

the opening being delineated by the protective layer; and the securing mechanism being operatively integrated into the protective layer, wherein the securing mechanism selectively seals the opening.

9. The waste scooper for safely retrieving and storing waste as claimed in claim 8 comprises:

the securing mechanism comprises a drawstring and a string conduit;

the string conduit being externally connected around the protective layer;

the string conduit being connected around the opening;

the drawstring traversing through the string conduit; and the string conduit being slidably engaged with the drawstring.

10. The waste scooper for safely retrieving and storing waste as claimed in claim 8, wherein the connecting portion is externally glued around the waste scoop.

11. The waste scooper for safely retrieving and storing waste as claimed in claim 8, wherein the waste scoop is a circular body.

12. The waste scooper for safely retrieving and storing waste as claimed in claim 8, wherein the waste bag is made of biodegradable material.

13. The waste scooper for safely retrieving and storing waste as claimed in claim 8, wherein the waste scoop is made of biodegradable material.

14. The waste scooper for safely retrieving and storing waste as claimed in claim 8, wherein the securing mechanism is made of biodegradable material.

* * * * *